US009557150B2

(12) United States Patent
Blackbeard

(10) Patent No.: US 9,557,150 B2
(45) Date of Patent: Jan. 31, 2017

(54) GRENADE ROUND

(71) Applicant: Atlantis Manufacturing Management Services Proprietary Limited, Bellville (ZA)

(72) Inventor: Gordon Henry Blackbeard, Bellville (ZA)

(73) Assignee: Atlantis Manufacturing Management Services Proprietary Limited, Bellville (ZA)

( * ) Notice: Subject to any disclaimer, the term of this patent is extended or adjusted under 35 U.S.C. 154(b) by 0 days.

(21) Appl. No.: 14/898,939

(22) PCT Filed: Jun. 20, 2014

(86) PCT No.: PCT/IB2014/062474

§ 371 (c)(1),
(2) Date: Dec. 16, 2015

(87) PCT Pub. No.: WO2014/203215

PCT Pub. Date: Dec. 24, 2014

(65) Prior Publication Data

US 2016/0238362 A1 Aug. 18, 2016

(30) Foreign Application Priority Data

Jun. 20, 2013 (ZA) ..... 2013/04585

(51) Int. Cl.
*F42B 5/02* (2006.01)
*F42B 5/285* (2006.01)
*F42C 19/08* (2006.01)

(52) U.S. Cl.
CPC ..... *F42C 19/083* (2013.01); *F42B 5/285* (2013.01); *F42C 19/0823* (2013.01); *F42B 5/02* (2013.01); *F42C 19/08* (2013.01)

(58) Field of Classification Search
CPC ..... F42C 19/08; F42C 19/083; F42C 19/0823; F42B 5/02; F42B 5/285
(Continued)

(56) References Cited

U.S. PATENT DOCUMENTS 5,936,189 A 8/1999 Lubbers
6,832,557 B2 * 12/2004 Torsten ..... F42B 8/10 102/439

(Continued)

FOREIGN PATENT DOCUMENTS

FR 1506813 A * 12/1967 ..... F42B 5/36
WO WO 2005/043072 5/2005

OTHER PUBLICATIONS

International Search Report and Written Opinion mailed Sep. 25, 2014 in PCT/IB2014/062474 (10 pgs.).

*Primary Examiner* — James S Bergin
(74) *Attorney, Agent, or Firm* — Foley & Lardner LLP

(57) ABSTRACT

A grenade round 10 comprises a projectile 12, a case 14 and a high-low propellant propulsion system 16. The system 16 includes a propellant chamber assembly 30 for holding a propelling charge 32. The assembly 30 comprises a chamber body insert 38 which defines an internal cavity and a base plate insert 42 which closes off the internal cavity. The insert 38 is screwed into the case, while the insert 42 is screwed into the insert 38. The insert 42 defines a circumferential flange 60 which extends beyond and abuts a rim formation of the insert 38. The inserts define a high strength housing for the propelling charge which is able to withstand the high pressures resulting from combustion of the propelling charge. The flange provides a relatively large area for dissipation of energy resulting from combustion of the propelling charge, into the interface between the base plate insert and the case.

4 Claims, 4 Drawing Sheets

(58) Field of Classification Search
USPC ..... 102/430, 439, 469, 470
See application file for complete search history.

(56) References Cited

U.S. PATENT DOCUMENTS

| | | | | |
|---|---|---|---|---|
| 8,042,472 | B2 * | 10/2011 | Lubbers | F42B 5/16 102/202.1 |
| 8,418,621 | B2 * | 4/2013 | Kruse | F42B 5/26 102/469 |
| 2003/0136293 | A1 | 7/2003 | Torsten | |
| 2016/0018199 | A1 * | 1/2016 | Nemec | F42B 5/02 102/439 |

* cited by examiner

GRENADE ROUND

CROSS REFERENCE TO RELATED APPLICATIONS

This application is a National Phase Entry of PCT/IB2014/062474 filed Jun. 20, 2014, which claims priority to South African Patent Application No. 2013/04585 filed Jun. 20, 2013. The disclosures of all prior applications are hereby incorporated by reference in their entirety.

FIELD OF INVENTION

This invention relates to a grenade round. Although the principles of the invention can be applied to different types of projectiles, they are primarily adapted for use with 40 mm high velocity grenade rounds.

BACKGROUND TO INVENTION

The projectile of a 40 mm grenade round weighs approximately 240 g. The projectile of a 40 mm high velocity grenade round is launched by a firing weapon at a velocity of approximately 240 meters per second. A 40 mm grenade round comprises, broadly, a projectile and a case which houses a propulsion system. The propulsion system is typically referred to as a "high-low" system. A high pressure propellant chamber is provided in the base of the case, in which pressures exceed 190 MPa in the case of a 40 mm high velocity grenade round. The propellant chamber has one or more openings at one end, which lead into a low pressure chamber. The openings are closed by means of a burst diaphragm.

An initiating primer is contained in a primer chamber at an opposite end of the propellant chamber. A mechanical striker of a firing weapon is used to initiate the primer which then causes the propellant within the high pressure chamber to combust which in turn generates high pressure gases causing the burst diaphragm to rupture and expanding propellant gases to enter the low pressure chamber. The relatively low pressure gases act on the rear end of the projectile causing it to be propelled along the barrel of a firing weapon.

The applicant is aware of a problem encountered with conventional high velocity 40 mm grenade rounds wherein the primary chambers of such grenade rounds have been known to fail due to the high pressures to which they are subjected when the propellant charge initiates. Such failures can result in damage to, or destruction of the firing weapon and also possibly result in serious injury or fatality of the operator of the weapon.

It is an object of the present invention to ameliorate the problems described hereinabove with conventional grenade rounds.

SUMMARY OF INVENTION

According to the invention there is provided a grenade round including:

a projectile;

a case comprising a cylindrical side wall having an open front end to which the projectile is attached and a base wall formed integrally with the side wall and extending across the side wall at a rear end thereof, the case at least partially defining a primer chamber adjacent the base wall in which an initiating primer is held and into which a mechanical striker of a firing weapon can extend for detonating the primer, the side wall defining a low pressure chamber at an operative rear end of the projectile and having an internal screw thread formation; and a propellant propulsion system including a propellant chamber assembly including:

a) a cup-shaped chamber body insert defining an internal cavity for holding a propellant charge, the chamber body insert having an external screw thread formation which is screw threadingly engaged with the screw thread formation of the side wall, the chamber body insert having a front end defining at least one opening in communication with the low pressure chamber and an open rear end defining a rim formation, the chamber body insert having an internal screw thread formation near its open rear end; and b) a base plate insert which abuts the base wall of the case and which closes-off the open rear end of the chamber body insert thereby defining a high pressure chamber together with the chamber body insert, the base plate insert defining a central orifice which is in register with the primer chamber, the base plate insert defining a cylindrical locating formation which is received within the open rear end of the chamber body insert and which defines an external screw thread which is screw threadingly engaged with the internal screw thread of the chamber body insert, the grenade round being characterized in that the base plate insert defines a circumferential flange which abuts the rim formation of the chamber body insert and which extends beyond the rim formation.

The grenade round includes sealing means for forming a seal between the base plate insert and the base wall of the case. More particularly, the sealing means may be in the form of an O-ring seal member, which is seated between the base plate insert and the base wall of the case in an arrangement wherein the seal member surrounds the central orifice of the base plate insert.

The grenade round may be a 40 mm high velocity grenade round. In 40 mm high velocity grenade rounds the projectile is launched by a firing weapon at a velocity of approximately 240 meters per second and pressures in the high pressure chamber exceed 190 MPa when the propellant is initiated.

BRIEF DESCRIPTION OF THE DRAWINGS

Further features of the invention are described hereinafter by way of a non-limiting example of the invention, with reference to and as illustrated in the accompanying diagrammatic drawings. In the drawings.

DESCRIPTION OF PREFERRED EMBODIMENTS

Figure 1:
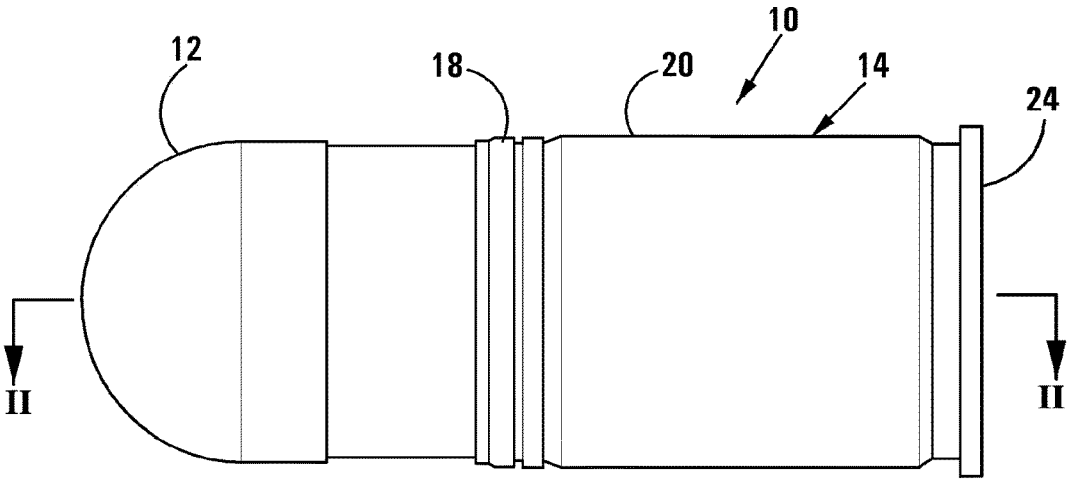
FIG. 1 shows a side view of a grenade round in accordance with the invention.
Figure 2:
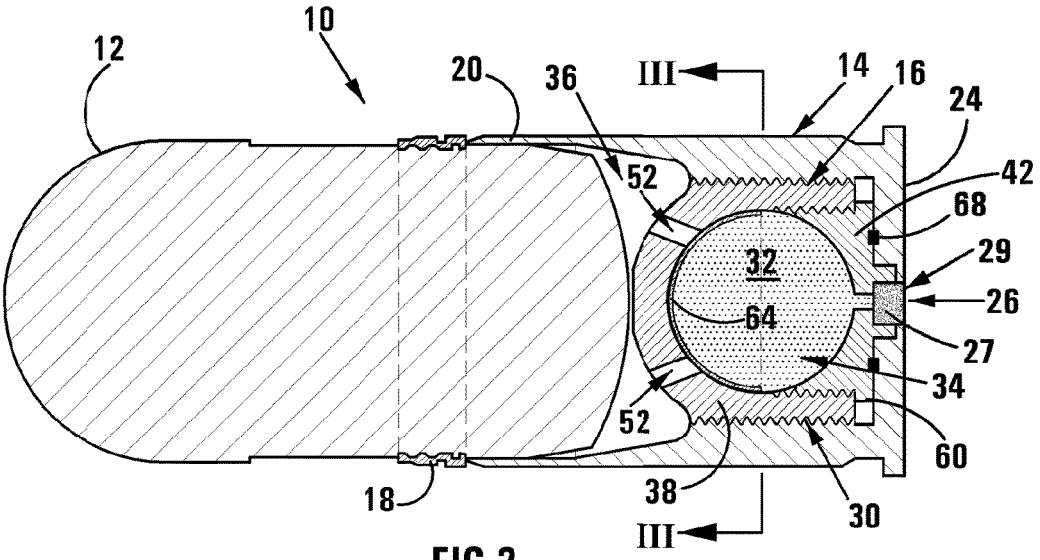
FIG. 2 shows a sectional side view of the grenade round of FIG. 1.
Figure 3:
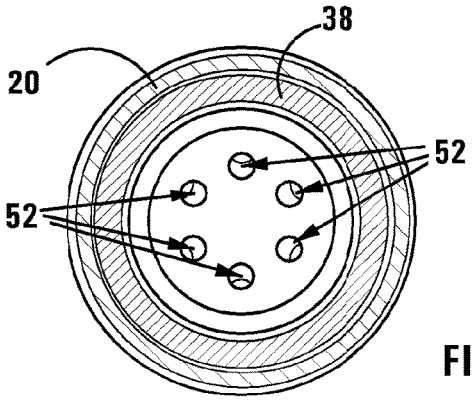
FIG. 3 shows a sectional end view of the grenade round of FIG. 1, sectioned along section line III-III of FIG. 2, with the propellant charge and burst diaphragm removed for clarity.
Figure 4:
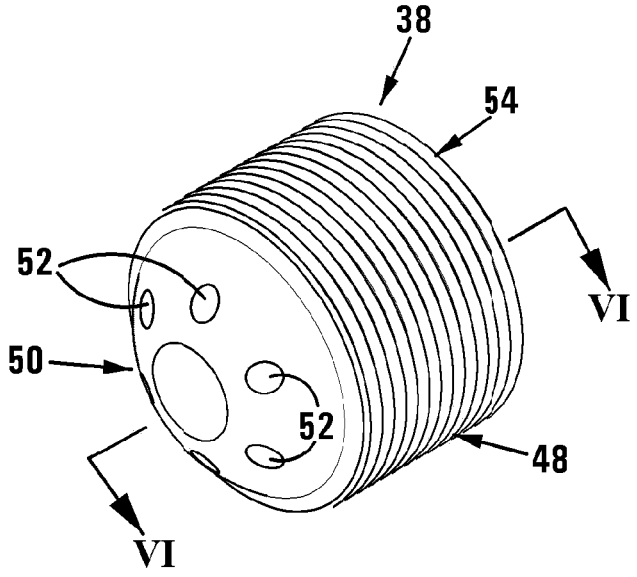
FIG. 4 shows a three-dimensional view of the chamber body insert of the grenade round of FIG. 1.
Figure 5:
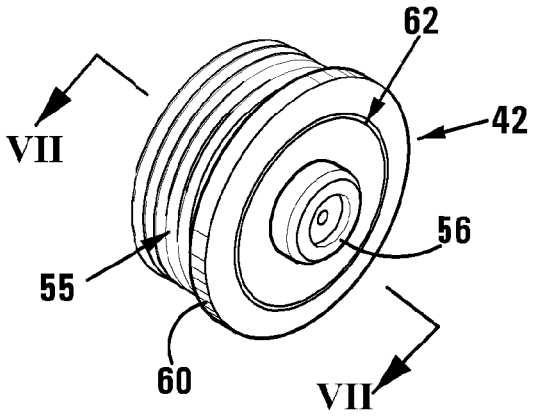
FIG. 5 shows a three-dimensional view of the base plate insert of the grenade round of FIG. 1.
Figure 6:
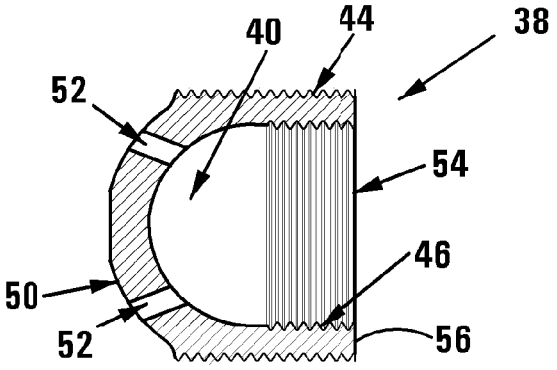
FIG. 6 shows a sectional side view of the chamber body insert of FIG. 4.
Figure 7:
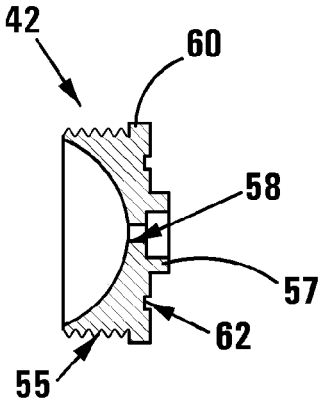
FIG. 7 shows a sectional side view of the base plate insert of FIG. 5.
Figure 8:
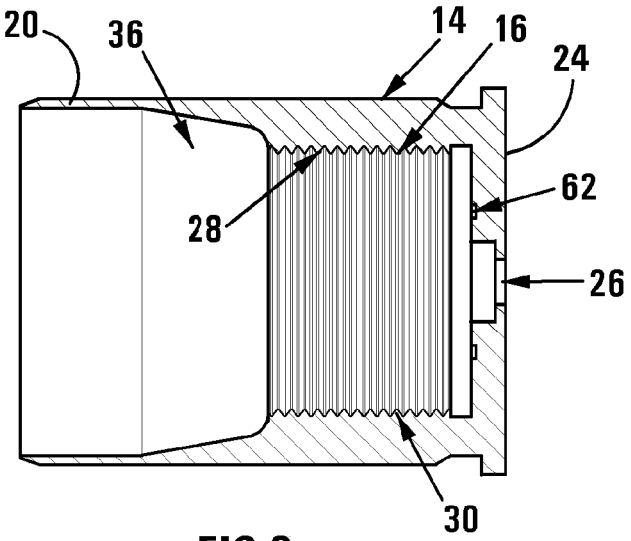
FIG. 8 shows a sectional side view of the case of the grenade round of FIG. 1.
Figure 9:
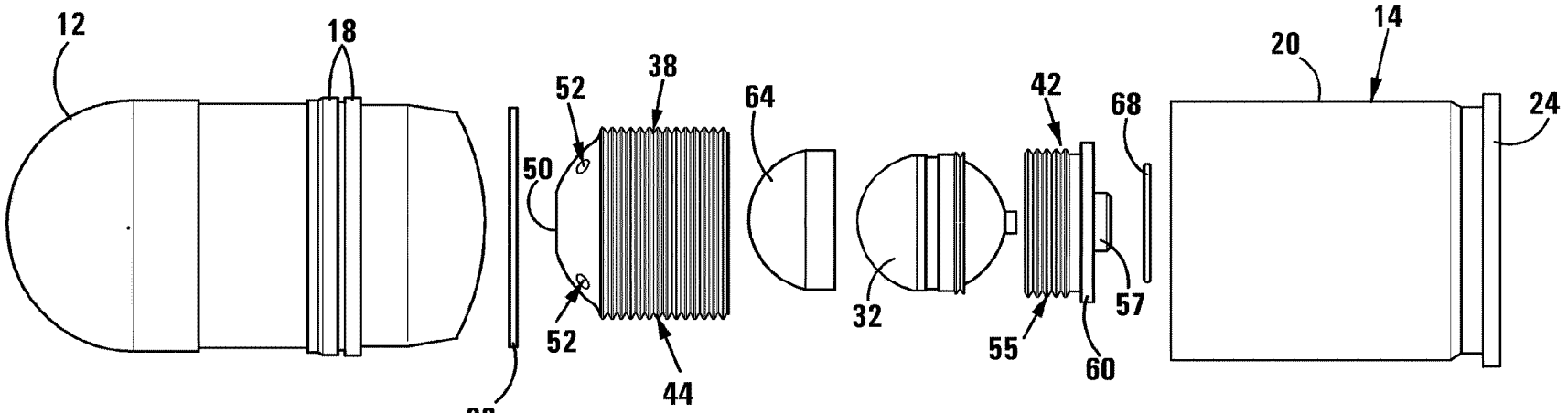
FIG. 9 shows an exploded side view of the grenade round of FIG. 1.

With reference to the drawings, a grenade round in accordance with the invention is designated generally by the reference numeral 10. The grenade round 10 is a 40 mm high velocity grenade round comprising, broadly, a projectile 12, a case 14 and a propellant propulsion system designated generally by the reference 16.

The case is connected to the projectile by means of such as, but not necessarily restricted to, deforming the open mouth of the case inwardly so as to frictionally and mechanically engage the projectile. The projectile defines a number of circumferential rib formations onto which a driving band 18 is fixedly secured. The driving band engages complementary guide formations defined on an inner side of the barrel of a firing weapon in order to provide the projectile with its flight spin characteristics and also acts as a gas seal between the projectile and the barrel of the firing weapon. The case has a cylindrical side wall 20 having an open front end 22 to which the projectile 12 is connected. A front end region of the side wall is crimped onto a rear end of the projectile, with an O-ring seal 23 providing a fluid-tight seal between the projectile and the case. The case includes a base wall 24 which is formed integrally with the side wall and which extends across the side wall at a rear end of the side wall. The base wall defines a cylindrical central aperture 26 which partially defines a primer chamber 29 in which an initiating primer 27 is located and into which a mechanical striker of a firing weapon extends for detonating the primer located in the cavity. The side wall of the case defines an internal screw thread formation 28, the purpose of which is explained in more detail hereinbelow.

The propellant propulsion system provides a high-low propulsion system for propelling the projectile 12 from the case 20. The propellant propulsion system 16 together with the case forms an integral part of the final assembled grenade round and includes a propellant chamber assembly designated generally by the reference numeral 30, for holding a propelling charge 32. The propellant chamber assembly defines a high pressure chamber 34 within which the propelling charge is held, while the case 14 defines a low pressure chamber 36 disposed between the high pressure chamber and a rear end of the projectile.

The propellant chamber assembly comprises a cup-shaped chamber body insert 38 defining an internal cavity 40 and a base plate insert 42 which closes off the internal cavity thereby to define the high pressure chamber 34. The chamber body insert is of a unitary construction and is screwed into the case 14. More specifically, the chamber body insert 38 has an external screw thread formation 44 which is screw threadingly engaged with the internal screw thread formation 28 of the side wall of the case. The chamber body insert also has an internal screw thread formation 46, the purpose of which is explained in more detail hereinbelow. The chamber body insert has a dome-shaped front end region 50 which defines a number of overflow channels 52 and an open rear end 54 defining a circular rim formation 56.

The base plate insert 42 is screwed into the rear end region of the chamber body insert thereby closing off the rear end of the chamber body insert so as to define the high pressure chamber 34. More specifically, the base plate insert has an external screw thread formation 55 which screw threadingly engages the internal screw thread formation 46 of the chamber body insert. The base plate insert defines a hollow cylindrical boss 57 which is received within the central aperture 26 in the base wall of the case. The base plate insert defines a central orifice 58 which opens into the boss. The boss defines the primer chamber 29 within which the primer 27 is held.

The base plate insert is of a unitary construction and defines a circumferential flange 60 which extends beyond the rim formation of the chamber body insert and which abuts the rim formation.

The chamber body insert 38 and the base plate insert 42 together define a spherical propellant chamber within which the propelling charge 32 is held. The chamber body insert and the base plate insert are of metal, typically carbon steel or high strength aluminium. If produced from aluminium, the chamber body insert and the base plate insert are chromic anodised so as to prevent any possibility of chemical incompatibility with a propelling charge in the propellant chamber.

The grenade round includes a dome-shaped burst diaphragm 64 which conforms to the shape of an inner side of the front end region of the chamber body insert. The burst diaphragm is fitted into the chamber body insert so as to line the inner side of the front end region and cover the overflow channels 52. In use, the burst diaphragm is configured to rupture upon initiation of the propelling charge, permitting expanding gases resulting from the initiation to travel along the overflow channels to the low pressure chamber 36.

The grenade round includes a rubber O-ring seal which is seated between the base plate insert and the base wall of the case so as to provide a fluid-tight seal between the base plate insert and the case. The base plate insert and the base wall of the case define complementary circular grooves 62 within which the O-ring seal is seated. It will be appreciated that the O-ring seal is located between the base plate insert and the base wall of the case such that the seal surrounds the primer chamber. The seal prevents any moisture ingress into the propellant chamber which could negatively affect the performance of the propellant charge located therein.

The grenade round further includes a burst diaphragm 64 which is configured so as to rupture after initiation of the propellant charge causing expanding propellant gases to enter the low pressure chamber 36 via the overflow channels 52 defined by the chamber body insert.

The propellant chamber assembly, together with the case, is configured to prevent mechanical failure of the propellant chamber resulting from causes such as a material or manufacturing defect in the case or overcharging of the propellant chamber with a propellant. The propellant chamber assembly and the case thus provides a high strength propellant chamber which is able to withstand pressures in excess of 190 MPa when a propellant contained therein is initiated and which prevents a blowout of propellant gases through the base wall of the case which can lead to damage to or destruction of the firing weapon resulting in serious injury or fatality of the operator of the firing weapon.

The propellant chamber assembly together with the case, thus defines a high strength housing which encapsulates the propelling charge and which is able to withstand the relatively high pressures resulting from initiation of the propelling charge. The screw thread connections between the chamber body insert and the case and between the base plate insert and the chamber body insert provide secure, high strength connections which are able to withstand the high pressure pulse in the propellant chamber without separation. The combination of the threaded interfaces between the chamber body insert, the base plate insert and the case, form an integrated structure with sufficient strength to absorb and dissipate the impulse energy generated by combustion of the propelling charge.

The flange of the base plate insert provides a relatively large surface area allowing for dissipation of excess energy resulting from combustion of the propelling charge, into the interface between the base plate insert and the case. The forces generated upon initiation of the propellant charge are thus distributed over a relatively large surface area provided by the flange thus reducing point loading which carries an associated risk of failure of the case resulting in a blowout.

The invention claimed is:

1. A grenade round including:

a projectile;

a case comprising a cylindrical side wall having an open front end to which the projectile is attached and a base wall formed integrally with the side wall and extending across the side wall at a rear end thereof, the case at least partially defining a primer chamber adjacent the base wall in which a primer is held and into which a mechanical striker of a firing weapon can extend for detonating the primer, the side wall defining a low pressure chamber at an operative rear end of the projectile and having an internal screw thread formation; and a propellant propulsion system including a propellant chamber assembly including:

a) a cup-shaped chamber body insert defining an internal cavity for holding a propellant charge, the chamber body insert having an external screw thread formation which is screw threadingly engaged with the screw thread formation of the side wall, the chamber body insert having a front end defining at least one opening in communication with the low pressure chamber and an open rear end defining a rim formation, the chamber body insert having an internal screw thread formation near its open rear end; and b) a base plate insert which abuts the base wall of the case and which closes-off the open rear end of the chamber body insert thereby defining a high pressure chamber together with the chamber body insert, the base plate insert defining a central orifice which is in register with the primer chamber, the base plate insert defining a cylindrical locating formation which is received within the open rear end of the chamber body insert and which defines an external screw thread which is screw threadingly engaged with the internal screw thread of the chamber body insert, the grenade round being characterized in that the base plate insert defines a circumferential flange which abuts the rim formation of the chamber body insert and which extends beyond the rim formation.

2. The grenade round as claimed in claim 1, which includes sealing means for forming a seal between the base plate insert and the base wall of the case.

3. The grenade round of claim 2, wherein the sealing means is in the form of an O-ring seal member, which is seated between the base plate insert and the base wall of the case in an arrangement wherein the seal member surrounds the central orifice of the base plate insert.

4. The grenade round as claimed in claim 1, wherein the grenade round is a 40 mm high velocity grenade round.

* * * * *